US005862660A

United States Patent [19]

Haasen et al.

[11] Patent Number: 5,862,660

[45] Date of Patent: Jan. 26, 1999

[54] METHOD FOR REMOVING YARN DEFECTS AT A WINDING HEAD OF A BOBBIN WINDING MACHINE

[75] Inventors: Rolf Haasen, Mönchengladbach; Heribert Kargel, Viereen; Hans-Günter Wedershoven, Nettetal, all of Germany

[73] Assignee: W. Schlafhorst AG & Co., Moenchen Gladbach, Germany

[21] Appl. No.: 936,863

[22] Filed: Sep. 24, 1997

[30] Foreign Application Priority Data

Sep. 30, 1996 [DE] Germany ..... 196 40 184.4

[51] Int. Cl.[6] ..... D01H 17/00

[52] U.S. Cl. ..... 57/22; 57/261; 57/264; 242/475.1; 242/475.4; 242/475.6

[58] Field of Search ..... 242/475.1, 475.3, 242/475.4, 475.5, 475.6; 57/22, 261, 264

[56] References Cited

U.S. PATENT DOCUMENTS

| | | | |
|---|---|---|---|
| 4,703,900 | 11/1987 | Noshi et al. | 242/35.5 R |
| 4,817,425 | 4/1989 | Ueda et al. | 73/160 |
| 4,854,515 | 8/1989 | Tone | 242/36 |
| 5,426,929 | 6/1995 | Schwalm et al. | 57/278 |
| 5,531,391 | 7/1996 | Yamamoto | 242/35.6 |

FOREIGN PATENT DOCUMENTS

| | | | |
|---|---|---|---|
| 2 466 421 | 4/1981 | France . | |
| 0 419 827 A2 | 8/1990 | Germany . | |
| 39 11 505 A1 | 10/1990 | Germany . | |
| 40 04 028 A1 | 8/1991 | Germany . | |
| 59-71435 | 4/1984 | Japan | 57/22 |
| 684 790 A5 | 12/1994 | Switzerland . | |

*Primary Examiner*—William Stryjewski

*Attorney, Agent, or Firm*—Kennedy Covington Lobdell & Hickman, LLP

[57] ABSTRACT

A method for removing both long and short yarn defects at the winding heads of a bobbin winding machine. Following the appearance of a yarn defect, the length of the defective yarn between the time of the appearance of the defect and the time of a subsequent yarn cut is determined. A suction tube is positioned in front of the winding bobbin to aspirate the defective yarn therefrom. The yarn is unwound, the entry of the yarn into the suction tube is determined by means of a sensor disposed therein, and the yarn length unwound from the winding bobbin and entering the suction tube is determined. The unwinding process is stopped at the time when, on the basis of the detected length of defective yarn, a sufficient yarn length has been aspirated into the suction tube so that, upon subsequent insertion of the yarn from the winding bobbin into the yarn end connecting device, the yarn length wound since the appearance of the yarn defect remains outside of the yarn end connecting device for the purpose of being cut and discarded.

10 Claims, 2 Drawing Sheets

METHOD FOR REMOVING YARN DEFECTS AT A WINDING HEAD OF A BOBBIN WINDING MACHINE

FIELD OF THE INVENTION

The present invention relates to a method for removing defects from a traveling yarn being wound onto a bobbin at a winding head of a bobbin winding machine. More particularly, the invention relates to such a method wherein the length of the yarn wound onto the bobbin is determined and, when a yarn defect is detected, the winding process is interrupted by cutting the traveling yarn, the winding bobbin is stopped, a driving roller rotates the bobbin in an unwinding direction for a predetermined number of revolutions sufficient to unwind the defect and in the process the yarn unwound from the bobbin is aspirated into a suction tube positioned in front of the bobbin, the unwound yarn and the other cut end of the yarn are subsequently inserted into a yarn end connecting device wherein the unwound yarn from the winding bobbin is cut to remove the defective portion, and the winding process is restarted after the yarn ends have been connected.

BACKGROUND OF THE INVENTION

In the course of rewinding a yarn from a delivery bobbin to a winding bobbin in a bobbin winding machine, the traveling yarn is continuously monitored for yarn defects. The yarn defects are cut out of the yarn, the two yarn ends being created are connected with each other again, and the winding process is started again. In the course of thusly removing yarn defects, it must be assured that the yarn defect is completely removed, regardless of whether it involves punctiform or long thin or thick sections. Furthermore, only the defective yarn portion is to be removed during the process, so that the least amount of yarn waste is created.

A winding device is known from German Published, Non-Examined Patent Application DE-OS 20 36 898, wherein the winding bobbin is immediately braked after a yarn defect has been detected, without the yarn being cut. The rotational pulses of the bobbin or the winding drum are counted from the appearance of the yarn defect until the winding bobbin comes to a stop. As the winding bobbin is subsequently unwound, the rotational pulses are counted backward to zero when the defective yarn is unwound. The unwound yarn is aspirated as a loop and then contains the defect. After cutting off the defective yarn loop, the resulting defect-free upper thread and lower thread are connected with each other.

This known method is only sensible at low winding speeds, because otherwise a considerable length of yarn would be wound onto the winding bobbin from the appearance of the defect until the stopping of the winding bobbin, which then constitutes waste. Furthermore, when braking sharply there is the danger of the yarn tearing. If the surface of the bobbin is braked by means of a winding roller, there is the danger of damage to the outermost yarn layers. The time required for unwinding the excess yarn furthermore results in a reduction in the efficiency of the machine.

It is also known from German Patent Publication DE 39 11 505 A1 to permit the traveling yarn to run up on the sharply braked winding bobbin following the appearance of a defect. This method also results in a considerable amount of waste yarn being wound onto the winding bobbin in the braking phase. The time required for the reverse winding of the winding bobbin during unwinding of the defective yarn is either limited by a time relay, wherein the predetermined unwinding time is based on experimental values or, in the course of unwinding, the yarn is directed past a sensor for detecting the passage of the defective portion. The steps for eliminating the defective portion and for restoring the yarn connection are initiated thereafter.

If the time for unwinding the defective yarn portion is limited by a time relay, the unwinding time must be set to the most disadvantageous circumstances which could result when the yarn end wound on the winding bobbin is not immediately aspirated and the defect is an extended one. For this reason, the suction tube is left to aspirate along the circumference of the delivery bobbin rotating in the unwinding direction until it can be assumed on the basis of experimental values that the yarn end has been aspirated. As a result, completely uncontrollable yarn lengths are aspirated into the suction tube, depending on whether the yarn start was already found immediately upon positioning the suction tube in front of the delivery bobbin, or the starting end of the yarn was detected only at the end of the predetermined search time.

A method for cleaning out yarn defects is known from European Patent Publication EP 0 419 821 B1, wherein a differentiation is made between conventional yarn defects and yarn defects caused by an auxiliary piecing yarn which is used to repair yarn breaks in ring spinning machines. If a yarn defect caused by the normal spinning process occurs, a short, predetermined yarn piece is pulled off the winding bobbin and removed, while when a defect caused by piecing occurs, which can be detected by means of the yarn cross section, sufficient yarn is always removed from the winding bobbin so that the auxiliary yarn in its entire known length, together with the pieced location, is removed. Therefore two different yarn lengths are predetermined for the removal of any given defect, the shorter predetermined yarn length being intended for defects caused by the spinning process, and the longer predetermined yarn length being intended for defects caused by the auxiliary yarn. Because of the fixed yarn lengths to be removed, this method does not permit the precision removal of short yarn defects caused by spinning because then it would not be assured that longer yarn defects would be completely removed because of the fixed cleaning out length.

OBJECT AND SUMMARY OF THE INVENTION

It is accordingly an object of the instant invention to provide an improved method for removing yarn defects detected during a yarn winding operation and in the process to reduce yarn waste.

This object is attained in accordance with the invention by providing a method for removing defects from a traveling yarn being wound from a delivery bobbin onto a winding bobbin at a winding head of a bobbin winding machine, basically comprising the steps of monitoring the traveling yarn for defects and, when a yarn defect has been detected, interrupting the winding process by cutting the yarn downstream of the detected defect thereby forming an upper yarn with the defect extending to the winding bobbin and a lower yarn extending from the delivery bobbin. The winding bobbin is stopped and the length of the upper yarn wound onto the winding bobbin between the time of the detection of the defect and the time of making the yarn cut is determined. The winding bobbin is then rotated in an unwinding direction for a predeterminable number of revolutions to unwind therefrom the defect of the upper yarn, and the upper yarn unwound from the winding bobbin is aspirated into a suction tube thereat. The presence of the upper yarn within the suction tube is sensed, and the unwinding of the upper yarn is stopped when the determined yarn length has been aspirated into the suction tube. The aspirated upper yarn from the winding bobbin is inserted into a yarn end connecting device with the yarn defect disposed outside of the yarn end connecting device to be cut and discarded, and similarly the lower yarn from the delivery bobbin is inserted into the yarn end connecting device. The upper and lower yarns are then spliced while cutting and removing the defect of the upper yarn, and then the winding process is restarted with no defect remaining in the yarn.

In accordance with the method of the invention, it is thus possible to completely remove the yarn over its defective length, but still to limit the removed yarn length to essentially only the length of the defect. So that only the yarn defect is exclusively cleaned, the entry of the yarn into the suction tube, which aspirates the defective yarn from the winding bobbin while rotating in the unwinding direction, is monitored by a sensor arranged in the suction tube. As soon as the sensor detects the entry of the yarn into the suction tube, the length of yarn unwound from the winding bobbin and entering the suction tube is determined. This yarn unwinding step and the aspiration of the yarn is stopped when a sufficient length of unwound yarn has been aspirated into the suction tube, as determined on the basis of the yarn winding length determined after detection of the defect, so that the length of yarn wound up since the appearance of the yarn defect will remain outside of the yarn end connecting device to be cut off when subsequently inserted into the yarn end connecting device. As a result, a completely defect-free upper yarn is provided for connection with the lower yarn.

The invention also makes it possible to remove relatively long yarn defects without generating additional waste. In this case, the cutting signal of the cleaner which checks the yarn quality to determine defects is suppressed until a yarn corresponding to the desired physical requirements of the yarn is again registered.

Since, besides those yarn defects limited in their length, there are also yarn defects whose length cannot be predicted, for example because of the presence of a wrong yarn count or with yarn with a continuing defect, a limitation on the length of the yarn to be checked is preselected for long yarn defects. If at the end of this preselected length a defect is still detected to be present in the yarn, the yarn is cut.

If a yarn cut is performed because of such a preselected defect length limitation, it is possible in accordance with a further aspect of the invention to set an alarm signal at the winding head to indicate that a defect has occurred which cannot be corrected by means of a yarn cut and the aspiration and removal of a defined yarn length. Appropriate action is then taken, e.g., further operation of the winding head is blocked, until an operator has checked the winding head and removed the defect.

In a further feature of the invention, it is possible to provide for a change of the delivery bobbin, in addition to removing the yarn defect, when a yarn cut is made because of a preselected length limitation. Under such circumstances, it can be assumed that the yarn remaining on the first delivery bobbin is also defective and that therefore the entire delivery bobbin should be changed.

According to a further aspect of the invention, it is possible to mark or otherwise identify delivery bobbins detected to have defective yarn thereby to prevent them from being again placed into a machine, and possibly also to indicate the reason for the removal of the delivery bobbin. For example, each delivery bobbin or the support for each delivery bobbin, e.g., a pallet, peg tray, or the like, may be provided with a device in which data can be stored to provide information regarding the delivery bobbin at a reading station.

In accordance with another feature of the invention, the length of the already aspirated yarn is compared with the defective length during the removal of yarn defects when the defective yarn end aspirated from the winding bobbin is registered by the sensor in the suction tube. By means of this comparison, a decision can be made whether the defect is already in the suction tube or whether it is necessary to unwind an appropriately longer defective portion of the yarn which has been wound on the winding bobbin. The control of the drive motor of the device which drives the winding bobbin in the unwinding direction, i.e., normally the winding roller, is dependent on this comparison. The suction tube only remains in front of the winding bobbin until the defective piece of yarn has been completely wound off the winding bobbin, and thereafter it is immediately pivoted into a position for inserting the yarn in the yarn end connecting device. Since this step in the present process continues for only the time necessary for the yarn end to be actually registered and the yarn defect to be aspirated off the delivery bobbin, the course of the present process is considerably accelerated in comparison with the conventional method in which the suction tube remains in front of the delivery bobbin for a fixed predetermined length of time.

According to a further feature of the invention, the sensor is positioned in the suction tube at a sufficient distance from its mouth that, with short yarn defects up to a length of a few centimeters, the defective portion of the yarn is already aspirated sufficiently far into the suction tube when the yarn end is first detected in the suction tube by the sensor. In addition, the placement of the sensor in the suction tube can be selected in relation to the distance possibly existing between the cleaner and the cutting device. In order to be able to insert a yarn grasped by means of a suction tube securely into the yarn end connecting device, the yarn must be present in the suction tube to a defined length so that the yarn is in a tensioned state. Since a defective length of only a few centimeters is already contained in the length of yarn which is wound off the winding bobbin during a single revolution of the winding roller, the defective piece of yarn as a rule will already be positioned in the suction tube when the minimum length of yarn required for secure insertion of the yarn into the yarn end connecting device has been aspirated. Therefore, when the sensor registers the yarn end in the suction tube, the latter can be immediately pivoted into a position for inserting the yarn into the yarn end connecting device. Thus, with short yarn defects, it is not necessary that the suction tube remain in front of the delivery bobbin any longer than the time until the yarn end has been registered in the suction tube by the sensor.

Another aspect of the invention makes it possible, at the time when the defective yarn length has been wound off the winding bobbin and has been aspirated by the suction tube, to clamp the yarn in the suction tube. Otherwise, if the pivoting movement of the suction tube for inserting the yarn into the yarn end connecting device is not exactly matched to the revolutions of the winding bobbin while the yarn is unwound, the position of the yarn inside the suction tube can change as a result of the yarn being pulled out or further aspirated, whereby it cannot be assured whether the defective yarn portion lies completely outside of the yarn end connecting device. By means of the yarn clamping provided within the suction tube by the present invention, it is assured that the yarn end aspirated into the suction tube does actually remain in the suction tube and is not pulled out again. For this reason, the clamping of the yarn is only released when the defective yarn is cut at the yarn end connecting device.

Under a further feature of the present invention, the circumferential velocity of the winding roller when the yarn is pulled off the winding bobbin is matched to the pivot movement of the suction tube to accomplish unwinding of a yarn length which precisely corresponds to the yarn length between the winding bobbin and the yarn end connecting device. This aspect of the invention can additionally be used in conjunction with clamping of the yarn in the suction tube, but has particular advantage if the suction tube does not have a clamping device. By means of this step, it is assured that no additional yarn can be aspirated into the suction tube or pulled out of the suction tube during the insertion of the yarn into the yarn end connecting device, and it is therefore assured that the defective yarn portion lies completely outside of the yarn end connecting device after having been inserted therein.

Additional features and advantages of the present invention will be described and understood in more detail with reference to the accompanying drawings and the following description of an exemplary embodiment.

DETAILED DESCRIPTION OF THE PREFERRED EMBODIMENT

Figure 1:
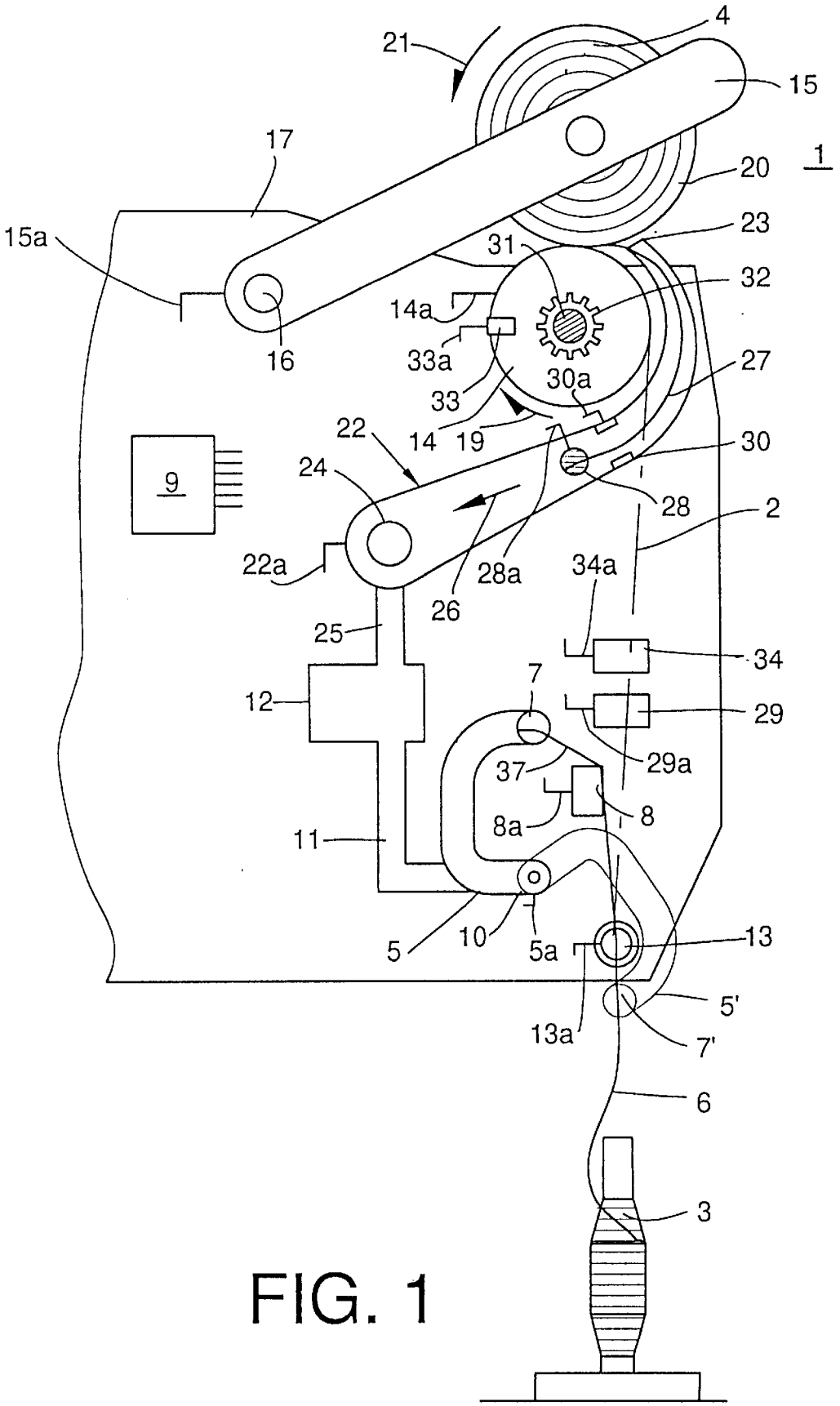
FIG. 1 is an end elevational view of a winding head on a bobbin winding machine equipped in accordance with the present invention with a suction tube positionable in front of the winding bobbin for aspiration of a yarn following the cutting thereof because of a detected defect.

Referring now to the accompanying drawings and initially to FIG. 1, the structure of a winding head 1 of a bobbin winding machine (not shown in greater detail herein for sake of simplicity and clarity of illustration) is schematically shown. Only the features of the winding head necessary for understanding the invention are represented and described.

FIG. 1 represents the situation in which, because a yarn defect has been detected, the normal operation of the winding head 1 for rewinding yarn supplied from a delivery bobbin 3 onto a winding bobbin 4 has been interrupted by lifting the winding bobbin 4 out of peripheral driven contact with a friction driving roller 14, at the same time the yarn path has been interrupted by cutting the yarn, and measures have been initiated for removing the yarn defect, all according to the present invention. This interruption in the normal travel path 2 followed by the yarn during winding operation between the delivery bobbin 3 and the winding bobbin 4 is indicated by the dashed line 2. Following the cutting of the yarn (by conventional means not shown), a yarn gripping suction tube 5 has been pivoted downwardly into a position in the yarn path 2 above the delivery bobbin 3 and has already aspirated the leading end of the yarn 6 fed from the delivery bobbin 3 (referred to herein as the lower yarn) and has delivered such yarn 6 to a yarn end connecting device 8, e.g., a splicing device. To this end, the gripper tube 5 has been pivoted from an initial yarn grasping position, represented at 5' in faint lines, wherein an aspirating opening 7 at the free end of the tube 5 for catching the lower yarn 6 is in the position 7' in the yarn path 2, into the position represented at 5 in full lines by means of a drive (not represented here) which is connected by means of a line 5*a* with a main central control device 9 for the winding head 1. The pivot joint 10, around which the gripper tube 5 is pivoted, simultaneously provides a pneumatic connection to a vacuum line 11 which communicates with a suction conduit 12 of the central vacuum supply of the bobbin winding machine. The lower yarn 6 held by the gripper tube 5 extends below the yarn end connecting device 8 in an opened yarn tensioner 13, which is also connected with the control device 9 of the winding head 1 via a line 13*a*.

The cutting of the yarn upon detection of the defect takes place at a location following the defect (as viewed in the direction of yarn travel) and thus, after the cutting of the yarn, the defective portion of the yarn is wound onto the winding bobbin 4. Before removing the defective portion of the yarn, it is therefore necessary to unwind the defective yarn piece completely from the winding bobbin 4, sufficiently that the defective portion of yarn lies completely outside the yarn end connecting device 8 after the yarn has been inserted into the yarn end connecting device 8. At the stage of the process shown in FIG. 1, the winding bobbin 4 has already been lowered again into contact with the winding roller 14. The winding bobbin 4 is supported by a bobbin holder 15, which is seated in a pivot joint 16 in the machine frame 17 (shown only schematically). The actuation of the drive (not represented here) for pivoting the bobbin frame 15 is controlled by the control device 9 via the line 15*a*.

The winding roller 14 is driven by a drive (not represented here) which is also connected by means of the line 14*a* with the control device 9. For unwinding the defective yarn piece, the winding roller 14 is driven opposite the normal yarn winding direction, as indicated by the arrow 19, and in turn its circumferential periphery 20 drives the winding bobbin 4 by frictional contact therewith in the yarn unwinding direction 21.

Figure 2:
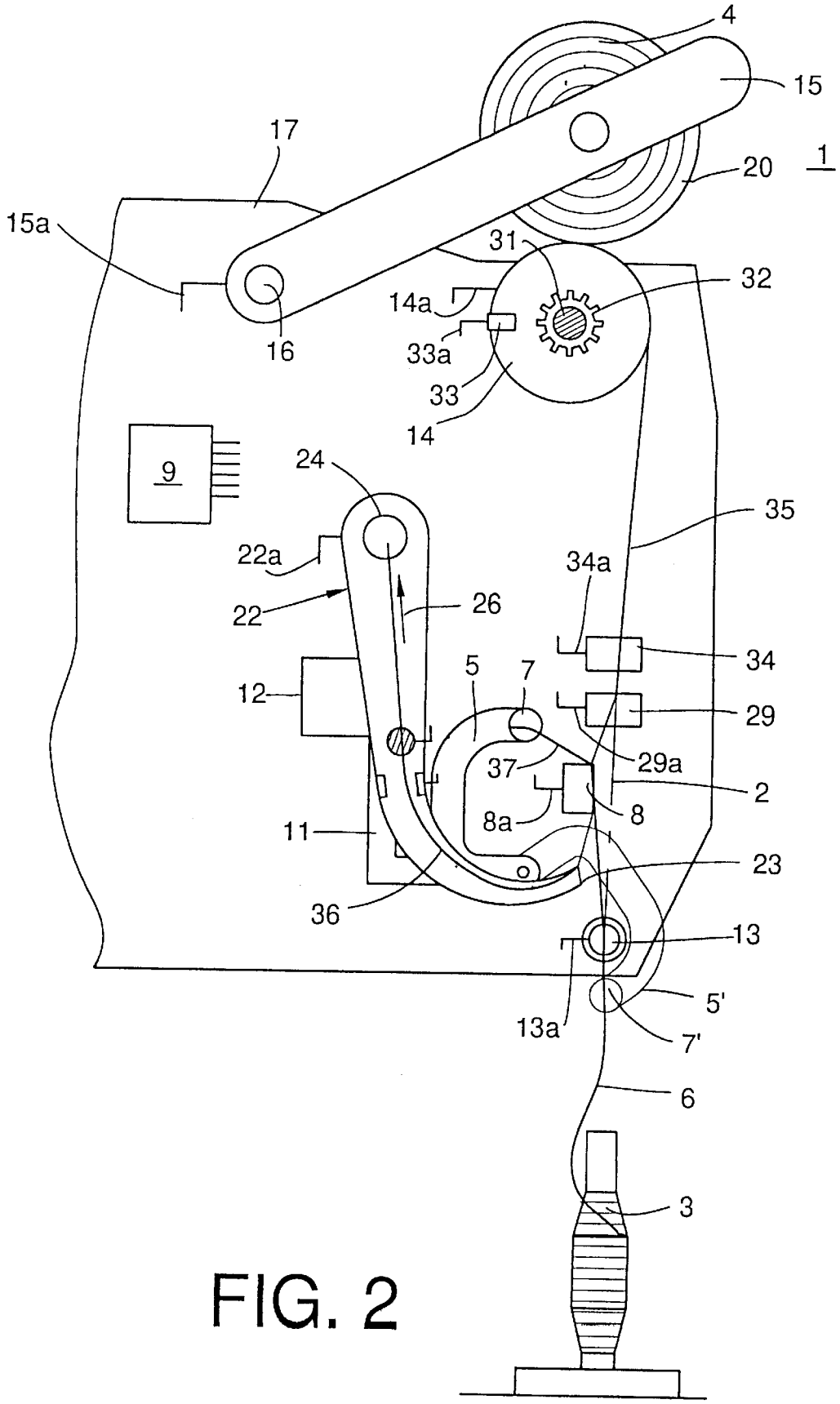
FIG. 2 is a similar end elevational view of the winding head of FIG. 1 showing the winding head after the yarn has been inserted into the yarn end connecting device by the suction tube.

A suction tube 22 is seated in a pivot joint 24 in the machine frame 17, which also provides communication of the tube 22 with the central suction conduit 12 of the vacuum supply of the bobbin winding machine via a line 25 therebetween. In FIG. 1, the suction tube 22 is shown to have been pivoted into an operating position with its mouth 23 in front of the circumferential surface 20 of the winding bobbin 4. FIG. 2 depicts the normal resting position of the suction tube 22. The pivotal movement of the suction tube 22 out of the resting position of FIG. 2 into the operating position of FIG. 1 is performed by means of a drive (not shown) which is connected via a line 22*a* with the control device 9. A valve (also not represented) is also controlled by the control device 9 and connects the suction tube 22 with the suction conduit 12.

As the winding bobbin 4 is rotated in the unwinding direction, the trailing cut yarn end 27 resting on the circumferential surface 20 of the winding bobbin 4 is aspirated into the suction tube 22 by means of the suction flow, symbolized by the arrow 26 in FIG. 1, prevailing at the mouth 23 of the suction tube 22, represented in section in FIG. 1. The exemplary illustration of FIG. 1 shows the moment in which the yarn end 27 has just reached a sensor 28 disposed in the suction tube 22. The presence of the yarn end 27 in the suction tube 22 is reported by the sensor 28 via the line 28*a* to the control device 9. The sensor 28 is arranged at a selected distance from the mouth 23 of the suction tube 22 that a sufficient length of yarn is aspirated in order to maintain the yarn tensioned during its insertion into the yarn end connecting device 8. With short defects in the range of millimeters to a few centimeters, the defective yarn piece will have thereby already been unwound and aspirated when the yarn end 27 has been aspirated as far as the sensor 28.

When the yarn end 27 has reached the sensor 28, a check must be made as to whether at this time the defective yarn piece has already been unwound from the winding bobbin 4 and whether therefore the unwinding and aspiration of the yarn can be stopped. To assist in this determination, a yarn cleaner device 29 is positioned within the normal yarn travel path 2 to detect the presence and length of defects in the traveling yarn and the cleaner 29 is connected to the central control device 9 via a signal line 29*a* to report such data. If the cleaner 29 has reported a short defect to the control device 9, and the length of yarn which has been unwound from the winding bobbin 4 as of the detection of the yarn end 27 by the sensor 28 is longer than the measured defect length, unwinding of the yarn is immediately stopped. The yarn end 27 can be clamped in the suction tube 22 by means of a clamping device 30 before the suction tube 22 is pivoted back into the initial position represented in FIG. 2 and thus, in the process of such pivotal movement of the tube 22, the tube inserts the yarn into the yarn end connecting device 8. The clamping device 30 is controlled via the line 30*a* by the control device 9. The clamping device 30 is reopened when the end length 27 of the yarn containing the defective yarn piece is subsequently cut from the trailing length of the yarn within the yarn end connecting device, whereby the yarn end 27 with the defect is aspirated through the tube 22 for disposal.

In the instant exemplary embodiment of the invention, the length of the defect in the wound yarn is determined as follows. A magnet wheel 32 is arranged on the shaft 31 of the winding roller 14, having a defined number of magnetic poles uniformly distributed over its circumference, and a sensor 33 is mounted in a stationary disposition on the machine frame adjacent the wheel 32 to register a magnetic pulse upon each passage of each magnetic pole. The number of the pulses of the magnetic poles is counted during each revolution of the magnetic wheel 32 and is transmitted by means of a signal line 33*a* to the computer of the control device 9, whereby the length of the yarn applied by the winding roller 14 to the winding bobbin 4 is calculated by means of the counted pulses. Of course, those persons skilled in the art will readily recognize that any other method for the measurement of the length of the yarn wound on the winding roller is also possible.

Thus, every time the cleaner 29 recognizes the start of a yarn defect, the length of the defective yarn piece is measured up to the time the cleaner 29 recognizes the end of the defect or until it can be concluded, because the detected measured length of defective yarn is extended, that most or all of the subsequent yarn can also be considered to be defective. At that time, a cutting and clamping device 34 is actuated by the control device 9 via the line 34*a* for cutting the yarn and the winding bobbin is stopped. The spatial arrangement of the cleaner 29 and the cutting device 34 is taken into consideration when issuing this cutting signal, so that the cut is always made behind the end of the yarn defect (as viewed in the traveling direction of the yarn being wound) with the exception of the yarn cut made when the yarn is continuously defective.

As the winding bobbin 4 is stopped, the cut yarn end 27 is wound onto the surface of the bobbin 4 at which the yarn end comes under the influence of the suction force applied through the suction tube 22, causing the yarn end to be aspirated into the tube as the winding bobbin is driven in reverse in an unwinding direction. When the yarn end 27 reaches the sensor 28 in the suction tube 22, a defined yarn length has necessarily already been unwound from the winding bobbin 4. If the measured length of the defect as previously determined by the cleaner 29 is less than the already unwound yarn length, unwinding of the yarn is immediately stopped and the suction tube 22 is pivoted back into its initial position as represented in FIG. 2 for inserting the yarn into the yarn end connecting device 8. If, however, the measured length of the yarn defect is greater than the yarn length which has been unwound as of the time that the sensor 28 detects the end 27, unwinding of the yarn from the winding bobbin 4 is continued and the additional yarn length continues to be aspirated by the suction tube 22. In the process, the unwound yarn length is continuously measured by means of the length measuring device, namely the sensor 33 in connection with the magnetic wheel 32, and is compared with the defective yarn length originally determined by the cleaner 29. When the yarn length unwound from the winding bobbin 4 matches the previously determined length of the defective yarn, unwinding of the yarn from the winding bobbin and aspiration by the tube 22 are stopped, and the suction tube 22 is then pivoted back into its initial position in order to insert the defective yarn into the yarn end connecting device 8 such that the defective portion of yarn comes to rest outside of the yarn end connecting device 8 and can be aspirated after cutting thereby prior to yarn end connecting operation.

FIG. 2 represents the situation wherein the suction tube 22 has returned to its initial position and in the process has inserted into the yarn end connecting device 8 the non-defective yarn 35, coming from the winding bobbin 4 and trailing the defective portion 36 of yarn. The aspirated defective yarn portion 36 has been drawn into the pivot tube 22 shown in section, and extends as far as the mouth 23 of the suction tube. Since in the instant example of FIG. 2 the defective portion of the yarn is relatively long, exceeding the minimum yarn length necessary to be aspirated as far as the sensor 28, the yarn extends through the opening in the pivot joint 24 into the adjoining vacuum line 11 and the suction conduit 12. To prepare for the connection of the respective upper and lower yarn ends from the winding and delivery bobbins 3,4 (in the instant example by pneumatic splicing in the yarn end connection device 8), the yarn pieces projecting past the splicing device 8 are cut off. Thus, the defective yarn piece 36 is aspirated into the suction conduit 12 by means of the suction flow still prevailing in the suction tube 22. The yarn piece 37 of the lower yarn 6 extending out of the yarn end connecting device 8 into the gripper tube 5 is also severed and aspirated off by the suction flow prevailing in the gripper tube 5. Thereafter splicing of the yarn ends of the upper yarn 35 and the lower yarn 6 is actuated via the line 8*a*. Following splicing, the yarn is released back into the yarn path 2 shown in dashed lines, and the winding process is again started with a spliced yarn free of defects.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method for removing defects from a traveling yarn being wound from a delivery bobbin onto a winding bobbin at a winding head of a bobbin winding machine, comprising the steps of monitoring the traveling yarn for defects and, when a yarn defect has been detected, interrupting the winding process by cutting the yarn downstream of the detected defect thereby forming an upper yarn with the defect extending to the winding bobbin and a lower yarn extending from the delivery bobbin, stopping the winding bobbin, determining the length of the upper yarn wound onto the winding bobbin between the time of the detection of the defect and the time of making the yarn cut, rotating the winding bobbin in an unwinding direction for a predeterminable number of revolutions to unwind therefrom the defect of the upper yarn, aspirating the upper yarn unwound from the winding bobbin into a suction tube thereat, sensing the presence of the upper yarn within the suction tube, stopping the unwinding of the upper yarn when the determined yarn length has been aspirated into the suction tube, inserting the aspirated upper yarn from the winding bobbin into a yarn end connecting device with the yarn defect disposed outside of the yarn end connecting device to be cut and discarded, inserting the lower yarn from the delivery bobbin into the yarn end connecting device, splicing the upper and lower yarns while cutting and removing the defect of the upper yarn, and then restarting the winding process.

2. The method in accordance with claim 1, wherein the monitoring of the yarn for defects comprises conveying the yarn through a yarn cleaner for comparing the yarn against a predetermined yarn profile and, when a defect is detected as a deviation from the predetermined yarn profile, suppressing the cutting of the yarn until detection of a downstream portion of the yarn in compliance with the yarn profile is again detected.

3. The method in accordance with claim 2, wherein the cutting of the yarn is actuated after a predetermined length of the defective yarn has been reached.

4. The method in accordance with claim 3, and further comprising triggering an alarm at the winding head when cutting is actuated based on a predetermined length of the defective yarn without detection of a downstream portion of the yarn in compliance with the yarn profile.

5. The method in accordance with claim 3, and further comprising changing the delivery bobbin following a cutting which is actuated based on a predetermined length of the defective yarn without detection of a downstream portion of the yarn in compliance with the yarn profile.

6. The method in accordance with claim 5, and further comprising marking the delivery bobbin from which the defective yarn was unwound to prevent it from being again placed in the winding machine.

7. The method in accordance with claim 1, wherein the inserting of the aspirated upper yarn from the winding bobbin into the yarn end connecting device comprises pivoting the suction tube into a disposition at the yarn end connecting device for inserting the yarn thereinto.

8. The method in accordance with claim 7, wherein the unwinding of the yarn from the winding bobbin comprises peripherally driving the winding bobbin by a driven friction roller and matching the circumferential velocity of the friction roller to the pivoting of the suction tube such that only the yarn length corresponding to the yarn path between the winding bobbin and the yarn end connecting device is unwound.

9. The method in accordance with claim 1, wherein the sensing of the presence of the upper yarn in the suction tube is performed at a distance from an entrance of the suction tube sufficient that yarn defects of a short length will have been aspirated into the suction tube at the time the aspirated yarn end is first sensed in the suction tube.

10. The method in accordance with claim 1, and further comprising, after unwinding of the defect from the winding bobbin and aspirating thereof by the suction tube, clamping the upper yarn in the suction tube and subsequently releasing the clamping when the yarn defect is cut at the yarn end connecting device.

* * * * *